US007100667B2

(12) United States Patent
Tomita

(10) Patent No.: US 7,100,667 B2
(45) Date of Patent: Sep. 5, 2006

(54) ROLL SCREEN

(75) Inventor: Katsu Aki Tomita, Chiba (JP)

(73) Assignee: G. E. Aluminium Sash Co., Ltd., Taipei (TW)

( * ) Notice: Subject to any disclaimer, the term of this patent is extended or adjusted under 35 U.S.C. 154(b) by 0 days.

(21) Appl. No.: 10/862,428

(22) Filed: Jun. 8, 2004

(65) Prior Publication Data

US 2005/0016696 A1 Jan. 27, 2005

(30) Foreign Application Priority Data

Jun. 17, 2003 (JP) ..... 2003-171765

(51) Int. Cl.
*A47G 5/02* (2006.01)

(52) U.S. Cl. ..... 160/273.1; 160/23.1

(58) Field of Classification Search ..... 160/23.1, 160/26, 27, 31, 32, 33, 268.1, 270, 271, 272, 160/273.1
See application file for complete search history.

(56) References Cited

U.S. PATENT DOCUMENTS 1,882,982 A * 10/1932 Schmiedeskamp ..... 160/273.1
4,821,786 A * 4/1989 Johnston ..... 160/23.1
5,505,244 A * 4/1996 Thumann ..... 160/23.1
6,059,007 A * 5/2000 Tomita ..... 160/242
6,405,781 B1 * 6/2002 Davies et al. ..... 160/23.1
6,463,983 B1 * 10/2002 Lang ..... 160/23.1
6,478,070 B1 * 11/2002 Poppema ..... 160/23.1
6,629,555 B1 * 10/2003 DeBlock et al. ..... 160/31
6,701,994 B1 * 3/2004 Goldenberg et al. ..... 160/31
6,814,127 B1 * 11/2004 Tagtow et al. ..... 160/31

* cited by examiner

*Primary Examiner*—David Purol
(74) *Attorney, Agent, or Firm*—Birch, Stewart, Kolasch & Birch, LLP

(57) ABSTRACT

A roll screen. The roll screen includes a receiving case, a guide rail, a moveable shaft, a flexible net, and a tape. The guide rail is connected to the receiving case, and includes a cap. The moveable shaft slides in the guide rail, and engages the cap. The flexible net includes an edge, a first end, and a second end. The first end is fixed in the receiving case. The second end is fixed to the moveable shaft. The tape is attached to the edge of the flexible net to enhance the strength of the edge of the flexible net.

15 Claims, 7 Drawing Sheets

ROLL SCREEN

This nonprovisional application claims priority under 35 U.S.C. § 119(a) on Patent Application No(s). 2003-171765 filed in JAPAN on Jun. 17, 2003, the entire contents of which are hereby incorporated by reference.

BACKGROUND

The invention relates to a roll screen, and in particular, to a roll screen with a flexible net that can be maintained in its guide rail.

In a conventional roll screen, a flexible net is received in a receiving case to form a net roll. One end of the flexible net is fixed to a winding shaft in the receiving case, and the other end thereof is fixed to a moveable shaft of the roll screen. By pulling the moveable shaft between guide rails of a frame of the roll screen, the flexible net can be extracted from the receiving case and stretched between the guide rails. After the moveable shaft is engaged with caps on the guide rails, the flexible net is framed by the receiving case, the moveable shaft, and the guide rails.

Nevertheless, when wind pressure is exerted on the flexible net framed by the receiving case, the moveable shaft, and the guide rails, the flexible net further expands such that more flexible net is pulled out of the receiving case. Thus, edges of the flexible net may be separated from the guide rails generating gaps therebetween. As a result, insects may fly into the area enclosed by the flexible net via the gaps.

Furthermore, when returning the extracted flexible net to the receiving case, interference is caused by the guide rails.

Thus, various roll screens have been provided to ameliorate the described disadvantages such as JP, H8-1654. U and JP, S62-135799, U. In one roll screen, a tape with a zip fastener is stitched to the edges of the flexible net. Edge-teeth of the tape are inserted into the rips of the guide rails so as to hold the flexible net inside the guide rails. In another roll screen, resin tape is disposed at each edge of the flexible net. A plurality of rivets are disposed at the resin tape to engage the rips of the guide rails, thus enhancing the strength of the edges of the flexible net and holding the flexible net inside the guide rails.

Nevertheless, since zip fasteners or rivets increase the thickness of the flexible net, the diameter of the net roll wound around the winding shaft in the receiving case increases. Thus, the net roll cannot be compactly received in a limited space. Moreover, since the zip fasteners are stitched to the edges of the flexible net, production time and cost are increased. Additionally, since rivets are disposed at the edges of the flexible net by passing therethrough, the weave of the flexible net may be damaged, thus deteriorating the strength thereof.

SUMMARY

In order to address the disadvantages of the aforementioned roll screen, an embodiment of the invention provides a roll screen with a flexible net that is not separated from guide rails even if wind pressure is exerted thereon.

Accordingly, an embodiment of the invention provides a roll screen comprising a guide rail, a moveable shaft, a flexible net, and a tape. The guide rail is connected to the receiving case, and comprises a cap. The moveable shaft slides in the guide rail, and engages the cap. The flexible net comprises an edge, a first end, and a second end. The first end is fixed in the receiving case. The second end is fixed at the moveable shaft. The tape is attached to the edge of the flexible net to enhance the strength of the edge of the flexible net.

It is noted that the tape may comprise polyester.

Furthermore, the roll screen comprises a protruding member, a sliding member, and a stopper. The protruding member is disposed on the edge of the flexible net, and comprises a box-shaped space communicating with the slit. The sliding member slides in the guide rail, and comprises a slit. The edge of flexible net is inserted into the slit. The protruding member is engaged with the slit. The stopper is disposed at a center of the guide rail to engage the sliding member.

Moreover, when the moveable shaft is engaged with the cap, the protruding member is located at a center of the edge of the flexible net.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow the accompanying drawings, which are given by way of reference only, and thus are not limitative of the present invention, and wherein.

DETAILED DESCRIPTION

Figure 1:
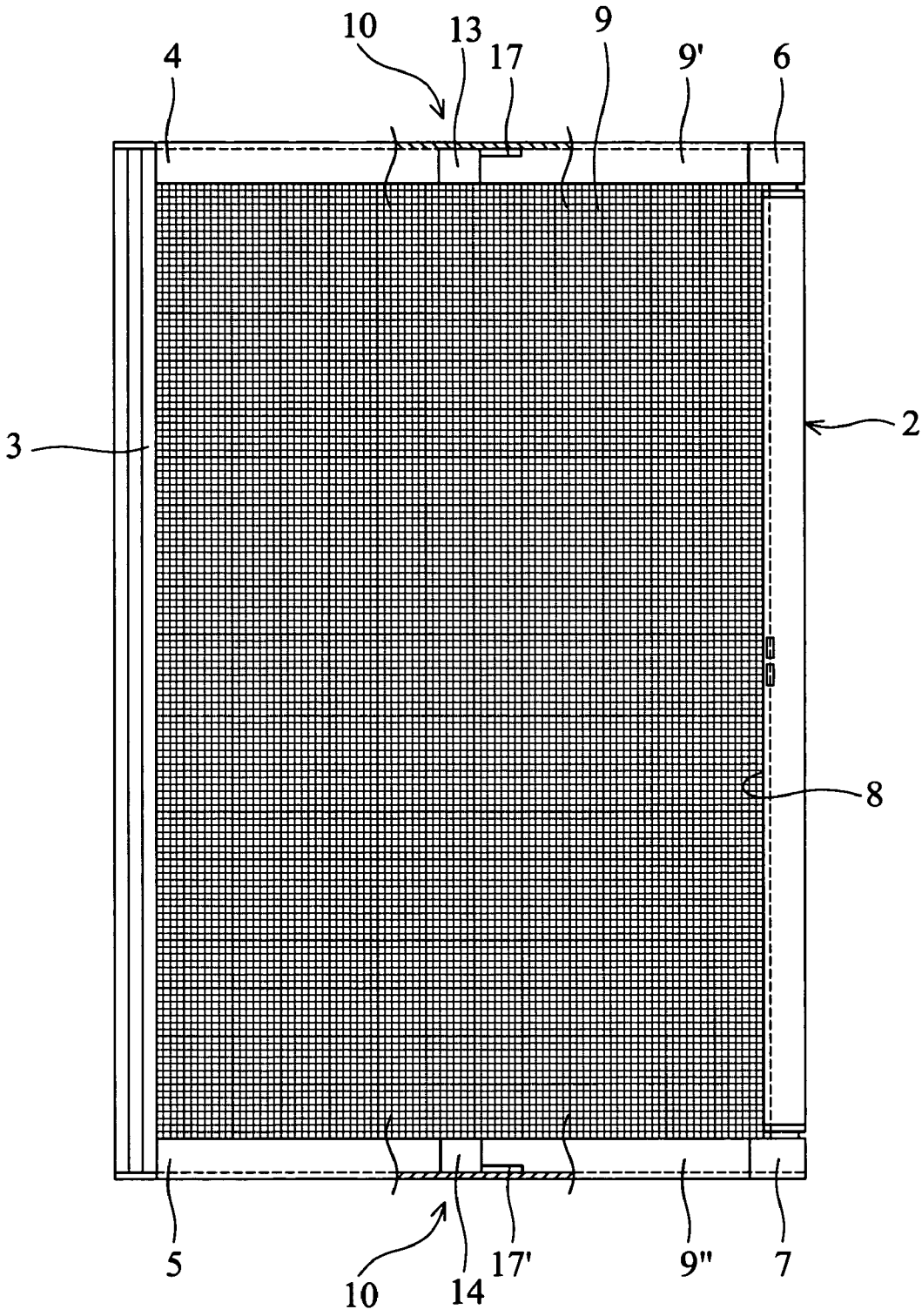
FIG. 1 is a front view of a roll screen as disclosed in an embodiment of the invention.

FIG. 1 is a front view of a roll screen 1 as disclosed in an embodiment of the invention. The roll screen comprises a receiving case 3, a top guide rail 4, a bottom guide rail 5, and a moveable shaft 8. The top guide rail 4 is connected to a top end of the receiving case 3, and comprises a top cap 6 at an end opposite to receiving case 3. The bottom guide rail 5 is parallel with the top guide rail 4, and connected to a bottom end of the receiving case 3. Additionally, the bottom guide rail 5 comprises a bottom cap 7 at an end opposite to receiving case 3. The moveable shaft 8 slides between the top guide rail 4 and the bottom guide rail 5, and engages the top cap 6 and the bottom cap 7. The receiving case 3, the top guide rail 4, the bottom guide rail 5, and the moveable shaft 8 constitute a frame 2 of the roll screen 1.

A net roll (not shown), for generating a flexible net 9, is received in the receiving case 3. One end of the flexible net 9 is fixed to a winding shaft (not shown) with a torsion spring (not shown), and the other end thereof is fixed to the moveable shaft 8 via a slit (not shown) of the receiving case 3.

By pulling the moveable shaft 8, the flexible net 9 is extracted from the receiving case 3 and spread out in the frame 2.

Figure 6:
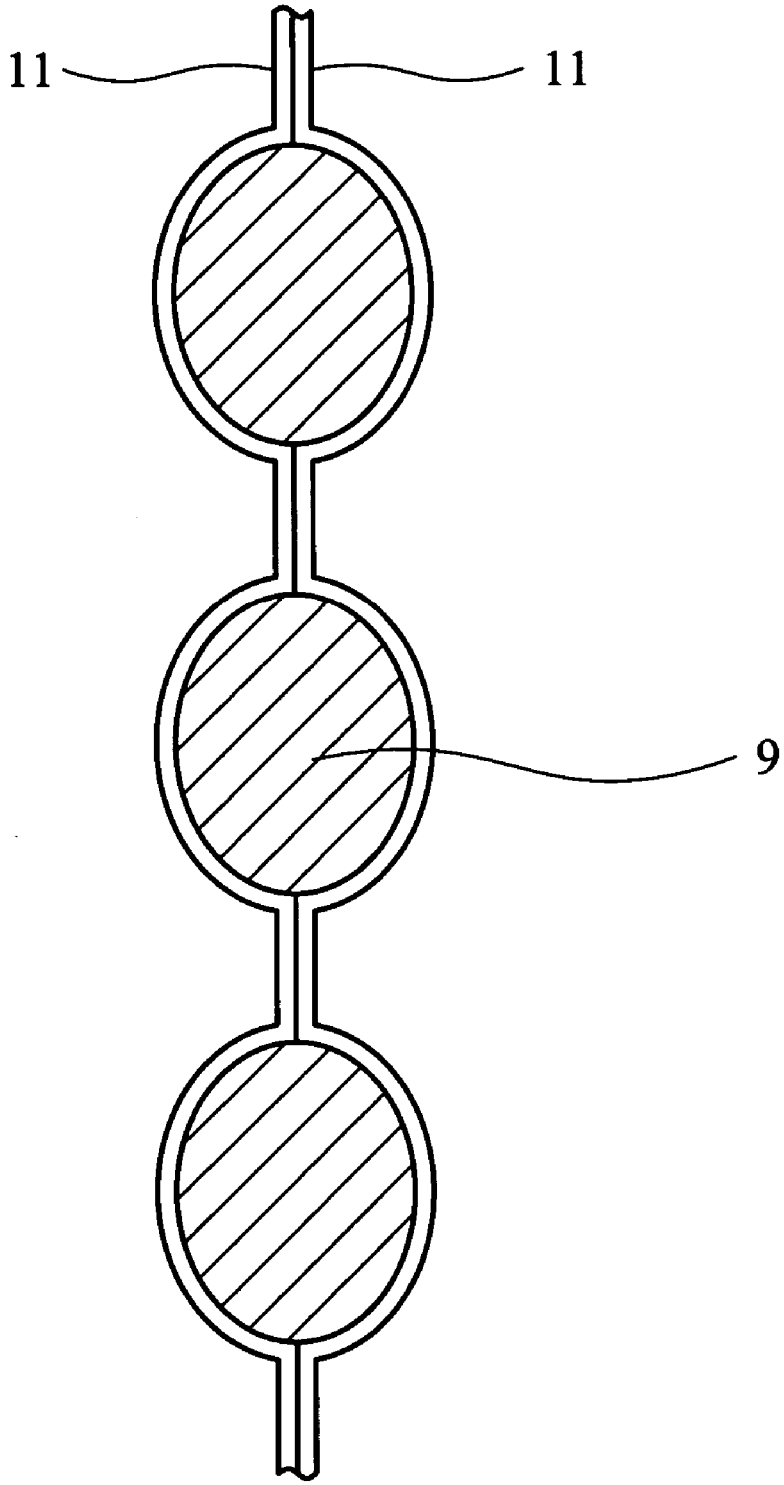
FIG. 6 is a cross section of tapes attached to the bottom edge of the flexible net.

Polyester tapes 11 are attached to each side of top and bottom edges 9', 9" of the flexible net 9 to enhance the strength thereof. As shown in FIG. 6, the polyester tape 11 attached to each side of the flexible net 9 are adhered to each other.

A top protruding member 12, such as a staple, is disposed on the top edge 9' of the flexible net 9. A bottom protruding member 12, such as a staple, is disposed on the bottom edge 9" of the flexible net 9. When the moveable shaft 8 is engaged with the top cap 6 and the bottom cap 7, the top protruding member 12 is located at a center of the top edge 9' of the flexible net 9 and the bottom protruding member 12 is located at a center of the bottom edge 9" of the of the flexible net 9.

A top sliding member 13 slides in the top guide rail 4, and comprises a first slit (not shown). Additionally, the top sliding member 13 comprises a first box-shaped space (not shown) communicating with the first slit, and an opening (not shown) communicating the first box-shaped space. A bottom sliding member 14 slides in the bottom guide rail 5, and comprises a second slit 15. The bottom sliding member 14 additionally comprises a second box-shaped space 16 communicating with the second slit 15, and an opening 16*a* communicating the second box-shaped space 16.

The top edge 9' of the flexible net 9 is inserted into the first slit of the top sliding member 13, and the bottom edge 9" of the flexible net 9 is inserted into the second slit 15. The top protruding member 12 is engaged with the first slit of the top sliding member 13, and the bottom protruding member 12 is engaged with the second slit 15.

Figure 2A:
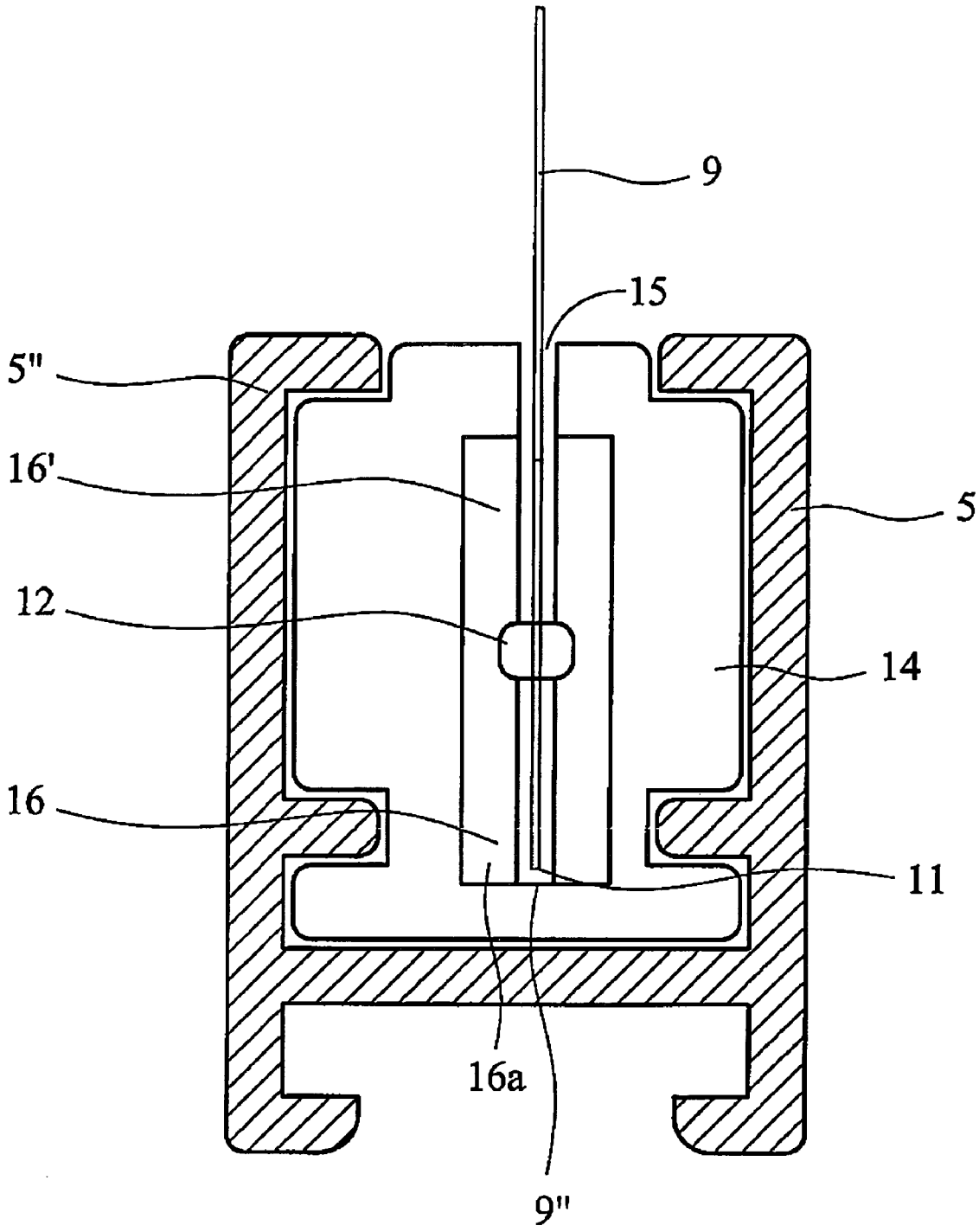
FIG. 2A is a longitudinal cross section of a bottom sliding member engaged with a bottom guide rail in FIG. 1.
Figure 2B:
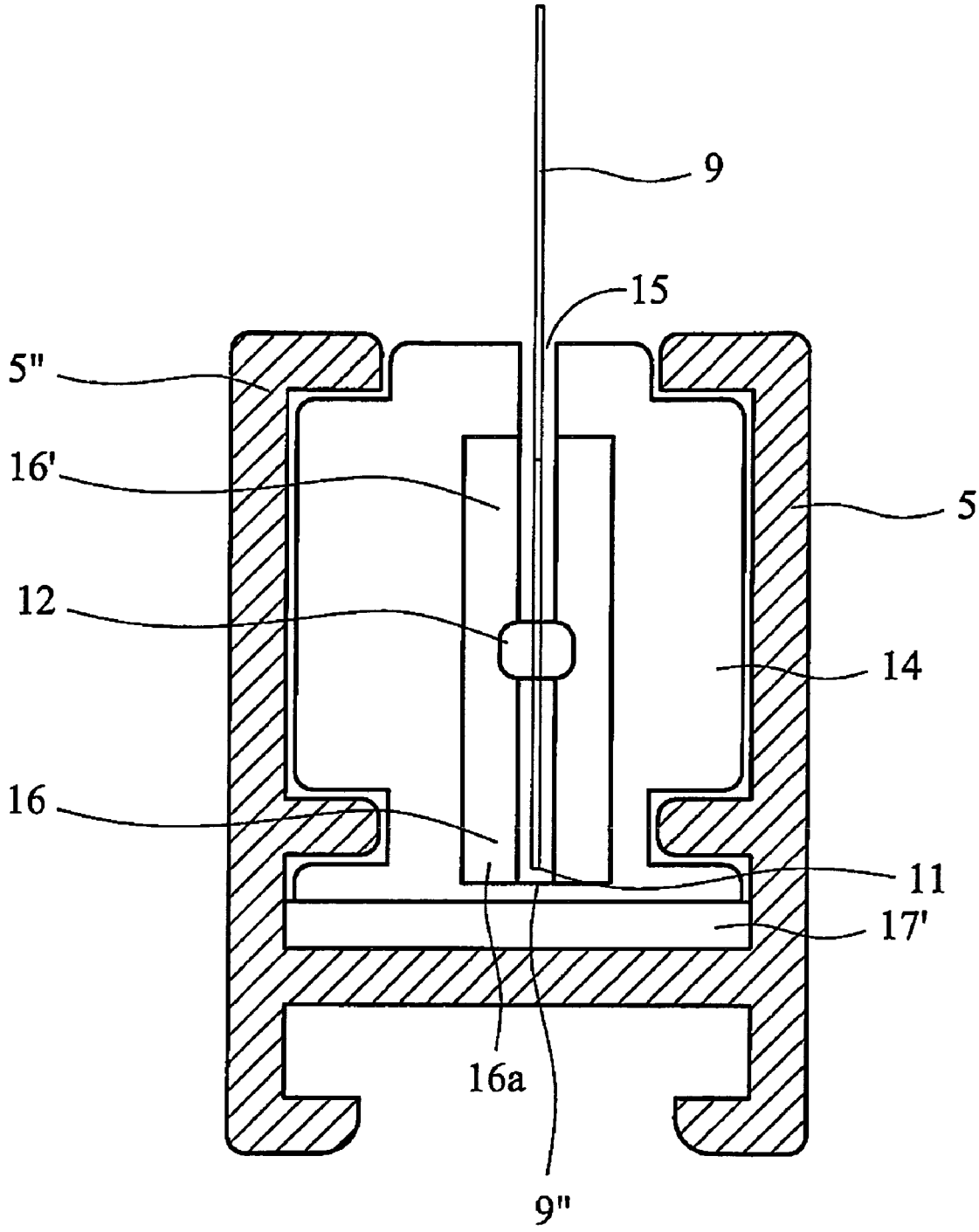
FIG. 2B is a longitudinal cross section of a bottom sliding member collided with a stopper in the bottom guide rail in FIG. 1.
Figure 3:
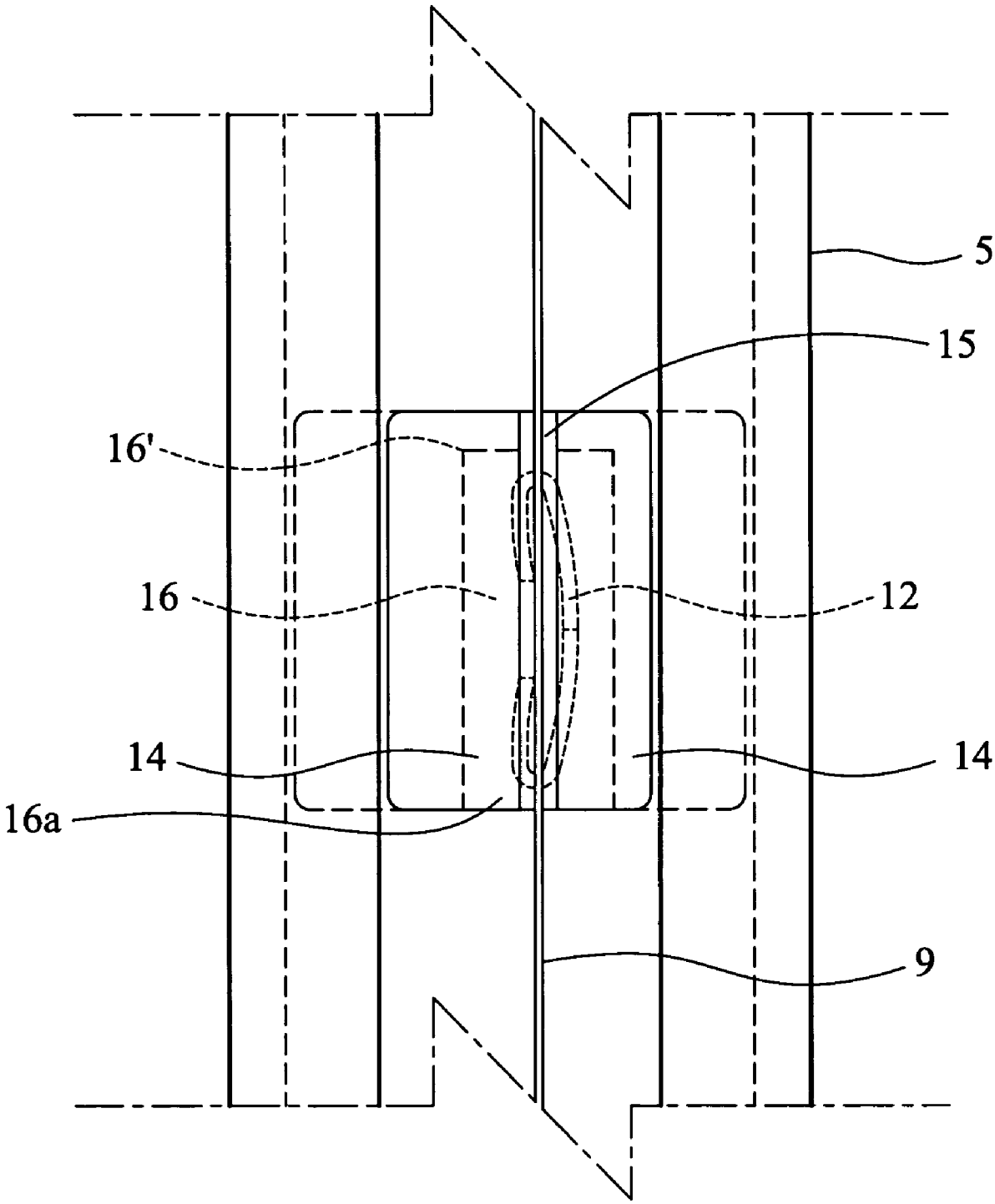
FIG. 3 is a plan view of the bottom sliding member engaged with the bottom guide rail.
Figure 4:
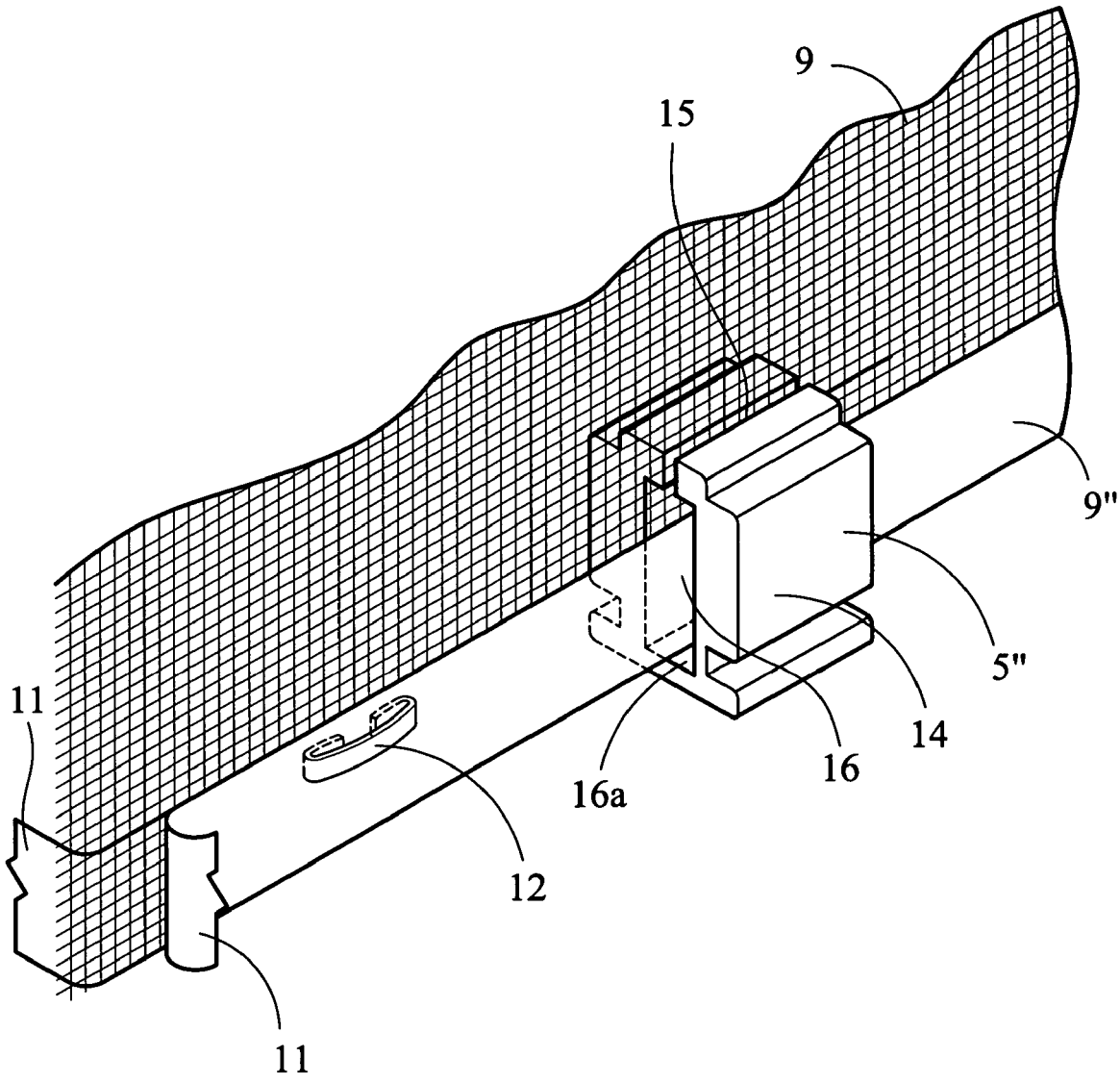
FIG. 4 is a partially enlarged view of a protruding member, a bottom edge of the flexible net, and the bottom sliding member.

FIG. 2A is a longitudinal cross section of a bottom sliding member engaged with a bottom guide rail in FIG. 1. FIG. 2B depicts a longitudinal cross section of a bottom sliding member collided with a stopper in the bottom guide rail in FIG. 1. A top stopper 17 is disposed at a center of the top guide rail 4 to stop the top sliding member 13, preventing the top sliding member 13 from over-sliding. A bottom stopper 17' is disposed at a center of the bottom guide rail 5 to stop the bottom sliding member 14, preventing the bottom sliding member 14 from over-sliding (as shown in FIG. 2B). It should be noted that the stopper 17, 17' may be variant in shapes and dispositions, as long as it can stop the movement of the sliding member 13, 14 without disturbing sliding of the shaft 8.

To stretch out the flexible net 9 in the frame 2, the moveable shaft 8 is pulled toward the top cap 6 and the bottom cap 7 to extract the net roll. During movement of the moveable shaft 8, the top and bottom edges 9', 9" of the flexible net 9 are inserted through the first and second slits 15 of the top and bottom sliding members 13, 14. Since the surface of the polyester tape 11 is smooth, the top and bottom edges 9', 9" of the flexible net 9 can smoothly pass through the first and second slits 15 of the top and bottom sliding members 13, 14.

When the flexible net 9 passes through the slits 15 of the top and bottom sliding members 13, 14, the top and bottom protruding members 12 easily engage the box-shaped space 16 of the top and bottom sliding members 13, 14 due to the large width of the opening 16*a*. Since the top and bottom protruding members 12 abut front surfaces 16' in the box-shaped space 16 to be engaged inside the slits 15, the top and bottom sliding members 13, 14 are integral with the flexible net 9.

Thus, the top and bottom sliding members 13, 14, integral with the flexible net 9, slides between the top and bottom guide rails 4, 5 along with the moveable shaft 8. Furthermore, when the moveable shaft 8 is engaged with the top and bottom caps 6, 7, the top and bottom sliding members 13, 14, are engaged with the top and bottom protruding members 12.

As a result, the top and bottom edges 9', 9" of the flexible net 9 can be stably maintained in the top and bottom guide rails 4, 5 by the top and bottom protruding members 12 engaging the top and bottom sliding members 13, 14. Even if wind pressure is exerted on the flexible net 9 in the frame 2, the top and bottom edges 9', 9" of the flexible net 9 will not separate from the guide rails 4, 5, thus preventing gaps therebetween. Additionally, the flexible net 9 can be smoothly returned to the receiving case 3.

Moreover, when the top and bottom sliding members 13, 14, slide unduly in the top and bottom guide rails 4, 5, the sliding members 13, 14 collide with the stoppers 17, 17' and then stop. Therefore, the bottom and top sliding members 13, 14, are still engaged with the top and bottom protruding members 12 by the top and bottom stoppers 17, 17'.

Since the protruding members 12 are on the external face of the roll screen 1, they can be easily repaired even if damaged. For example, the protruding members, such as staples, can be easily punched into the flexible net 9.

To retrieve the flexible net 9, the moveable shaft 8 is disengaged from the top and bottom caps 6, 7. The moveable shaft 8 is then pulled toward the receiving case 3 by the torsion spring in the receiving case 3. At the same time, the top and bottom protruding members 12 are easily separated from the top and bottom sliding members 13, 14 due to the openings 16*a*. Thus, the flexible net 9 can be quickly retrieved into the receiving case 3 without interference from the slits 15 of the top and bottom sliding members 13, 14.

Furthermore, when the moveable shaft 8 is pulled toward the receiving case 3, it abuts the top and bottom sliding members 13, 14 disengaged from the flexible net 9. Thus, when the flexible net 9 is fully received in the receiving case 3, the moveable shaft 8, the top and bottom sliding members 13, 14 are adjacent to the receiving case 3.

Figure 5:
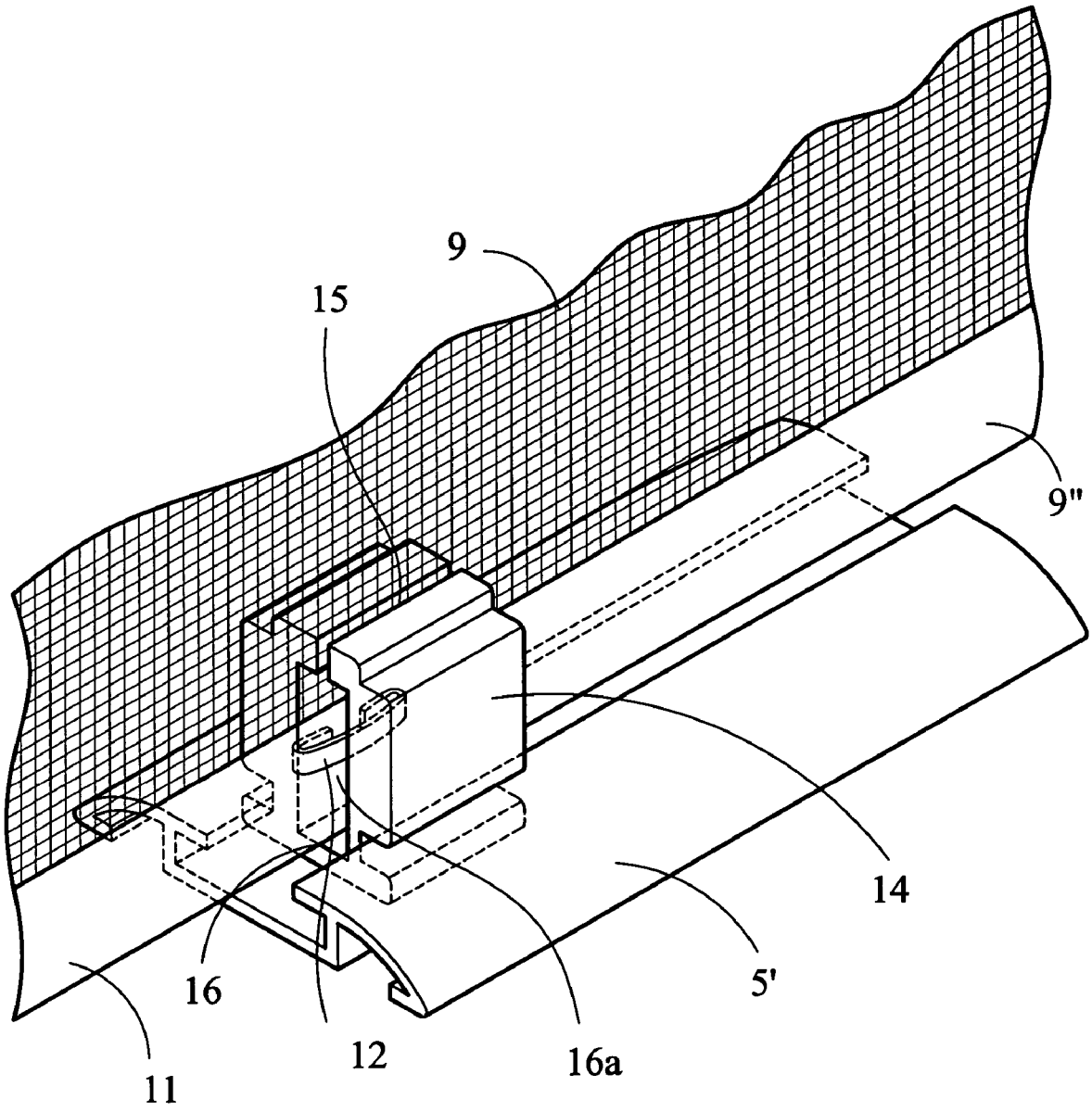
FIG. 5 is a partially enlarged view of a variant embodiment of the bottom guide rail.

FIG. 5 is a partially enlarged view of a variant embodiment of a bottom guide rail 5'. Compared with the bottom rail 5 in FIG. 2, an upper portion 5" of the bottom rail 5 is omitted. Thus, the bottom sliding member 14 is exposed, and the height of the bottom guide rail 5' is reduced. As a result, retrieval of the roll screen 1 is unhindered.

In summary, by engaging the protruding members with the sliding members, the flexible net can be maintained in the frame by means of the simple structure. Thus, even if wind pressure is exerted on the flexible net disposed in the frame, the top and bottom edges of the flexible net are not separated from the guide rails, thus preventing gaps therebetween. Additionally, the flexible net can be smoothly returned to the receiving case.

While the invention has been described by way of example and in terms of the preferred embodiment, it is to be understood that the invention is not limited to the disclosed embodiment. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A roll screen comprising:

a receiving case;

a guide rail, connected to the receiving case, comprising a cap;

a moveable shaft, sliding in the guide rail, engaged with the cap;

a flexible net comprising an edge, a first end, and a second end, wherein the first end is fixed in the receiving case, and the second end is fixed to the moveable shaft;

a tape attached to the edge of the flexible net to enhance the strength of the edge of the flexible net;

a sliding member sliding in the guide rail; and a protruding member disposed on the edge of the flexible net, wherein the sliding member comprises a slit, and the edge of flexible net is inserted into the slit, and the protruding member is engaged with the slit.

2. The roll screen as claimed in claim 1, wherein the tape comprises polyester.

3. The roll screen as claimed in claim 1, wherein the sliding member comprises a box-shaped space communicating with the slit.

4. The roll screen as claimed in claim 1, further comprising a stopper disposed at a center of the guide rail to stop the sliding member.

5. The roll screen as claimed in claim 1, wherein the protruding member is located at a center of the edge of the flexible net when the moveable shaft is engaged with the cap.

6. A roll screen comprising:

a receiving case;

a guide rail, connected to the receiving case, comprising a cap;

a moveable shaft, sliding in the guide rail, engaged wit the cap;

a flexible net comprising an edge, a first end, and a second end, wherein the first end is fixed in the receiving case, and the second end is fixed to the moveable shaft;

a protruding member disposed on the edge of the flexible net; and a sliding member, comprising a slit, sliding in the guide rail, wherein the edge of flexible net is inserted into the slit, and the protruding member is engaged with the slit.

7. The roll screen as claimed in claim 6, wherein the sliding member comprises a box-shaped space communicating with the slit.

8. The roll screen as claimed in claim 6, further comprising a stopper disposed at a center of the guide rail to stop the sliding member.

9. The roll screen as claimed in claim 6, wherein the protruding member is located at a center of the edge of the flexible net when the moveable shaft is engaged with to cap.

10. A roll screen comprising:

a receiving case having a top end and a bottom end;

a top guide rail, connected to the top end of the receiving case, comprising a top cap;

a bottom guide rail, connected to the bottom end of the receiving case, comprising a bottom cap;

a moveable shaft, sliding between the top guide rail and the bottom guide rail, engaged with the top cap and the bottom cap;

a flexible net, comprising a top edge, a bottom edge, a first end, and a second end, disposed between the top guide rail and the bottom guide rail, wherein the first end is fixed in the receiving case, and the second end is fixed to the moveable shalt;

a top protruding member disposed on the top edge of the flexible net;

a bottom protruding member disposed on the bottom edge of the flexible net;

a top sliding member, comprising a first slit, sliding in the top guide rail, wherein the top edge of the flexible net is inserted into the first slit, and the top protruding member is engaged with the first slit; and a bottom sliding member, comprising a second slit, sliding in the bottom guide rail, wherein the bottom edge of the flexible net is inserted into the second slit, and the bottom protruding member is engaged with the second slit.

11. The roll screen as claimed in claim 10, wherein the top sliding member comprises a first box-shaped space communicating with the first slit, and the bottom sliding member comprises a second box-shaped space communicating with the second slit.

12. The roll screen as claimed in claim 10, further comprising:

a top stopper, disposed at a center of the top guide rail to stop the top sliding member; and a bottom stopper, disposed at a center of the bottom guide tail to stop the bottom sliding member.

13. The roll screen as claimed in claim 10, further comprising a tape attached to the top and bottom edges of the flexible net to enhance the strength of the top and bottom edges of the flexible net.

14. The roll screen as claimed in claim 10, wherein the tape comprises polyester.

15. The roll screen as claimed in claim 10, wherein the top protruding member is located at a center of the top edge of the flexible net and the bottom protruding member is located at a center of the bottom edge of the of the flexible net when the moveable shaft is engaged with the top cap and the bottom cap.

* * * * *